US007637756B1

(12) United States Patent
Hsu

(10) Patent No.: US 7,637,756 B1
(45) Date of Patent: Dec. 29, 2009

(54) SOCKET SAFETY APPARATUS

(75) Inventor: Jung-Hui Hsu, Sinjhuang (TW)

(73) Assignee: Powertech Industrial Co., Ltd., Taipei Hsien (TW)

( * ) Notice: Subject to any disclaimer, the term of this patent is extended or adjusted under 35 U.S.C. 154(b) by 0 days.

(21) Appl. No.: 12/318,975

(22) Filed: Jan. 14, 2009

(51) Int. Cl.
*H01R 13/44* (2006.01)

(52) U.S. Cl. ..... 439/145; 439/137

(58) Field of Classification Search ..... 439/145, 439/137
See application file for complete search history.

(56) References Cited

U.S. PATENT DOCUMENTS 4,722,693 A * 2/1988 Rose ..... 439/137
4,867,694 A * 9/1989 Short ..... 439/137
5,020,997 A * 6/1991 Calderara et al. ..... 439/137
6,537,088 B2 * 3/2003 Huang ..... 439/137
6,776,630 B1 * 8/2004 Huang ..... 439/137
6,814,594 B1 * 11/2004 Huang ..... 439/137
7,355,117 B2 * 4/2008 Castaldo et al. ..... 174/53
7,510,412 B1 * 3/2009 Valentin ..... 439/145

* cited by examiner

*Primary Examiner*—Gary F. Paumen
(74) *Attorney, Agent, or Firm*—Rosenberg, Klein & Lee

(57) ABSTRACT

A socket safety apparatus includes an upper cover, a lower cover, a cover body, and a flexible element. The upper cover has two first plug holes. The lower cover is located below the upper cover and has two second plug holes that correspond to the first plug holes. The cover body, movably located between the upper cover and the lower cover, is supported above the lower cover via a supporting portion so that two sides of the cover body can move upwards and downwards. The cover body has two slant surfaces and two braking portions that respectively correspond to the first plug holes and second plug holes. The flexible element pushes the cover body so that the cover body is covered between the first plug holes and the second plug holes. Thereby, the apparatus can prevent foreign matter from being plugged into a socket, and prevent electric shock to user.

11 Claims, 5 Drawing Sheets

SOCKET SAFETY APPARATUS

BACKGROUND OF THE INVENTION

1. Field of the Invention

The present invention relates to a socket safety apparatus, in particular, the present invention relates to a socket safety apparatus that prevents foreign matters from being plugged into the socket to improve the safety of a socket.

2. Description of Related Art

Sockets are used for conducting power to electric equipments. Because electric equipments are common in our daily life, sockets may be considered a necessity of everyday life. Therefore, due to its importance, the functions of sockets are steadily improved to meet the user's requirements. For example, socket with an anti-dust cover is developed to prevent dust from entering the socket. Common conventional household socket does not prevent children from plugging foreign matters (such as a tiny metal matter—steel wire) into a socket. The children may get an electric shock, although the socket with safety apparatus (or anti-dust cover) is provided.

The safety apparatus (or anti-dust cover) of the prior art cannot effectively prevent the foreign matters from being plugging into the socket. When the plugging angle of the foreign matters is changed or the shape of the foreign matters is changed, the foreign matters can still be plugged into the socket to touch the conducting body and electrically shock the user.

SUMMARY OF THE INVENTION

One particular aspect of the present invention is to provide a socket safety apparatus that can really prevent foreign matters from being plugged into a socket and prevent the user from getting an electric shock. The safety of the socket is thus improved.

The socket safety apparatus includes an upper cover having two first plug holes, a lower cover located below the upper cover, a cover body movably located between the upper cover and the lower cover, and a flexible element for pushing the cover body. The lower cover has two second plug holes that correspond to the first plug holes. The upper cover is combined with the lower cover. The cover body has a supporting portion. The cover body is supported above the lower cover via the supporting portion. The cover body has two slant surfaces that correspond to the first plug holes. The cover body has two braking portions that correspond to the second plug holes. The flexible element pushes the cover body so that the cover body is covered between the two first plug holes and the second plug holes.

The present invention has the following characteristics. The present invention utilizes the seesaw principle of the cover body. When the first plug hole is plugged by a foreign matter, the cover body covers the area between the first plug hole and the second plug hole, and the braking portions of the cover body that correspond to the second plug holes can prevent the cover body from moving right or left so that the foreign matter cannot touch the conducting body. The present invention really can prevent the foreign matter from being plugged into the socket and prevent the user from getting an electric shock. The safety of the socket is improved. When a socket plug is normally plugged into the socket, the cover body moves normally forward to one side so that the socket plug can touch the conducting body.

For further understanding of the present invention, reference is made to the following detailed description illustrating the embodiments and examples of the present invention. The description is for illustrative purpose only and is not intended to limit the scope of the claim.

BRIEF DESCRIPTION OF THE DRAWINGS

The drawings included herein provide a further understanding of the present invention. A brief introduction of the drawings is as follows.

DETAILED DESCRIPTION OF PREFERRED EMBODIMENTS

Figure 1:
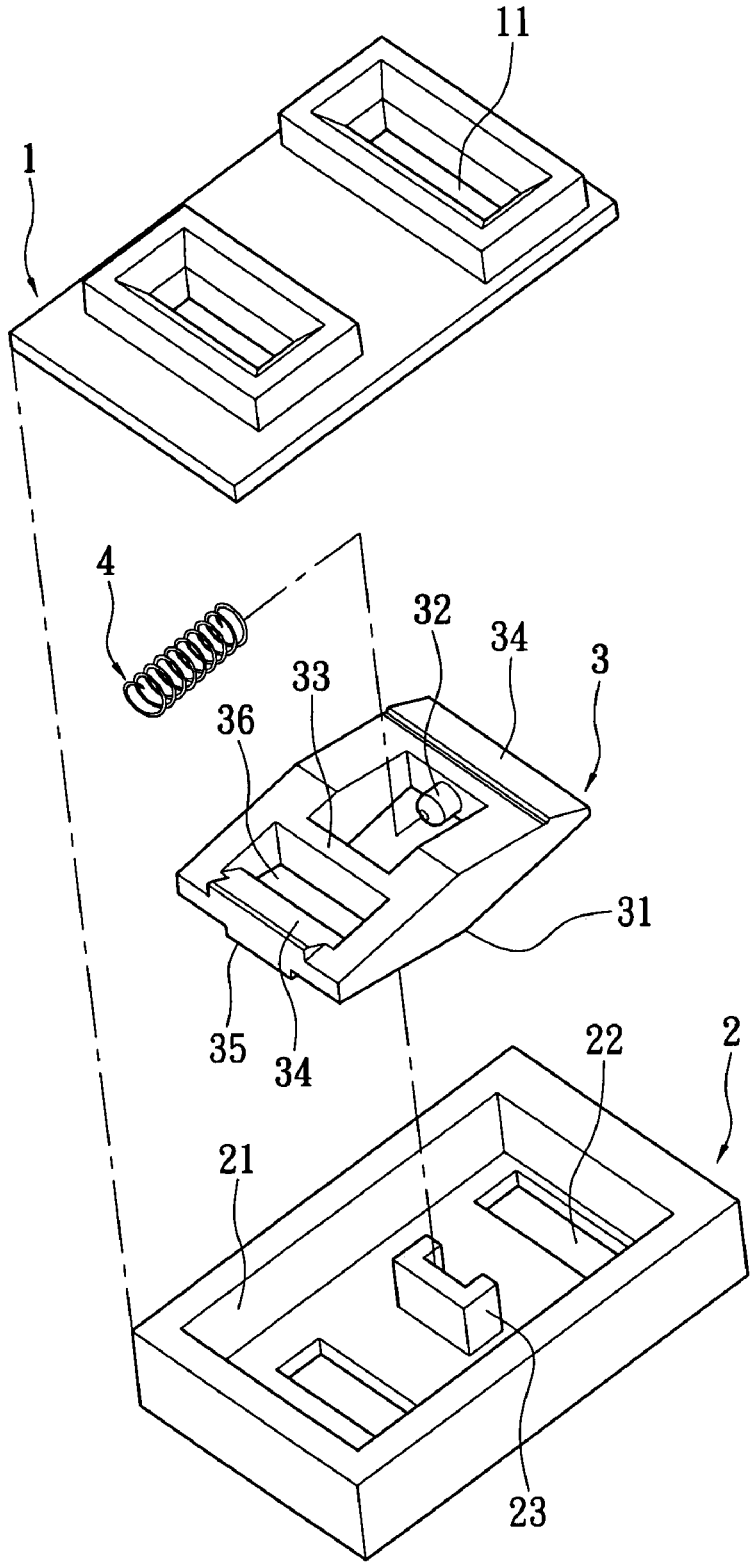
FIG. 1 is an exploded perspective view of the socket safety apparatus of the present invention.

Reference is made to FIGS. 1-4. The socket safety apparatus is located above the conducting body (i.e. electrical conductor, not shown in the figure) of the socket, and is used for preventing foreign matter from being plugged into the conducting body of the socket and preventing the user from getting an electric shock. In this embodiment, a socket safety apparatus that corresponds to a set of plugging hole is disclosed, but the number of plugging hole is not limited thereby.

The socket safety apparatus includes an upper cover 1, a lower cover 2, a cover body 3, and a flexible element 4. The upper body 1 is a board body, and its structure is not limited to a specific one. The upper cover 1 can be designed into a single unit, or a continuous structure with a plurality of covers. In this embodiment, the upper cover 1 is a single socket cover. The upper cover 1 has two first plug holes 11. The first plug holes 11 pass through the top surface and the bottom surface of the upper cover 1. The specification of the first plug holes 11 is not limited to a specific one, but can be varied to meet the necessary requirements. Furthermore, the first plug holes 11 can have a grounding pole.

The lower cover 2 is located below the upper cover 1. The lower cover 2 is a hollow shell body, and its structure is not limited to a specific one. The upper cover 2 can be designed into a single unit, or a continuous structure with a plurality of covers. In this embodiment, the lower cover 2 is a single shell body. The lower cover 2 has a receiving space 21 for receiving the cover body 3 and the flexible element 4. The top of the receiving space 21 has an opening, and can be sealed by being covered with the upper cover 1. The upper cover 1 and the lower cover 2 can be combined together via a wedging way, a screwing way, or a supersonic wave way.

The lower cover 2 has two second plug holes 22 that correspond to the first plug holes 11. The second plug holes 22 pass through the bottom surface of the lower cover 2. The second plug holes 22 link with the receiving space 21. The specification of the second plug holes 22 is not limited to specific one, but can vary to meet the requirements. Furthermore, the first plug holes 22 can have a grounding pole.

The receiving space 21 has a fastening column 23. In this embodiment, the fastening column 23 extends upwards from the bottom of the lower cover 2. The fastening column 23 is U-shaped, and is located between two second plug holes 22. The structure and location of the fastening column 23 is not limited to above, but can vary to meet the requirements.

The cover body 3 is located in the receiving space 21 of the lower cover 2 so that the cover body 3 is located between the upper cover 1 and the lower cover 2. In this embodiment, the cover body 3 is rhombus, but not limited thereby. The structure of the cover body 3 can be a structure that can make the cover body 3 move upwards and downwards or left and right. The center of the bottom surface of the cover body 3 has a supporting portion 31. The supporting portion 31 is a slant cone that protrudes from the bottom surface of the cover body 3. The supporting portion 31 contacts the lower cover 2 so that the cover body 3 is supported by the lower cover 2 via the supporting portion 31. The structure of the supporting portion 31 is not limited to above, and the supporting portion 31 can be a convex body with other shape or a structure with a supporting function. Thereby, the cover body 3 is located in the receiving space 21 between the upper cover 1 and the lower cover 2 same as the seesaw. The two sides of the cover body 3 each is supported by the supporting portion 31 to move upwards and downwards.

Figure 2:
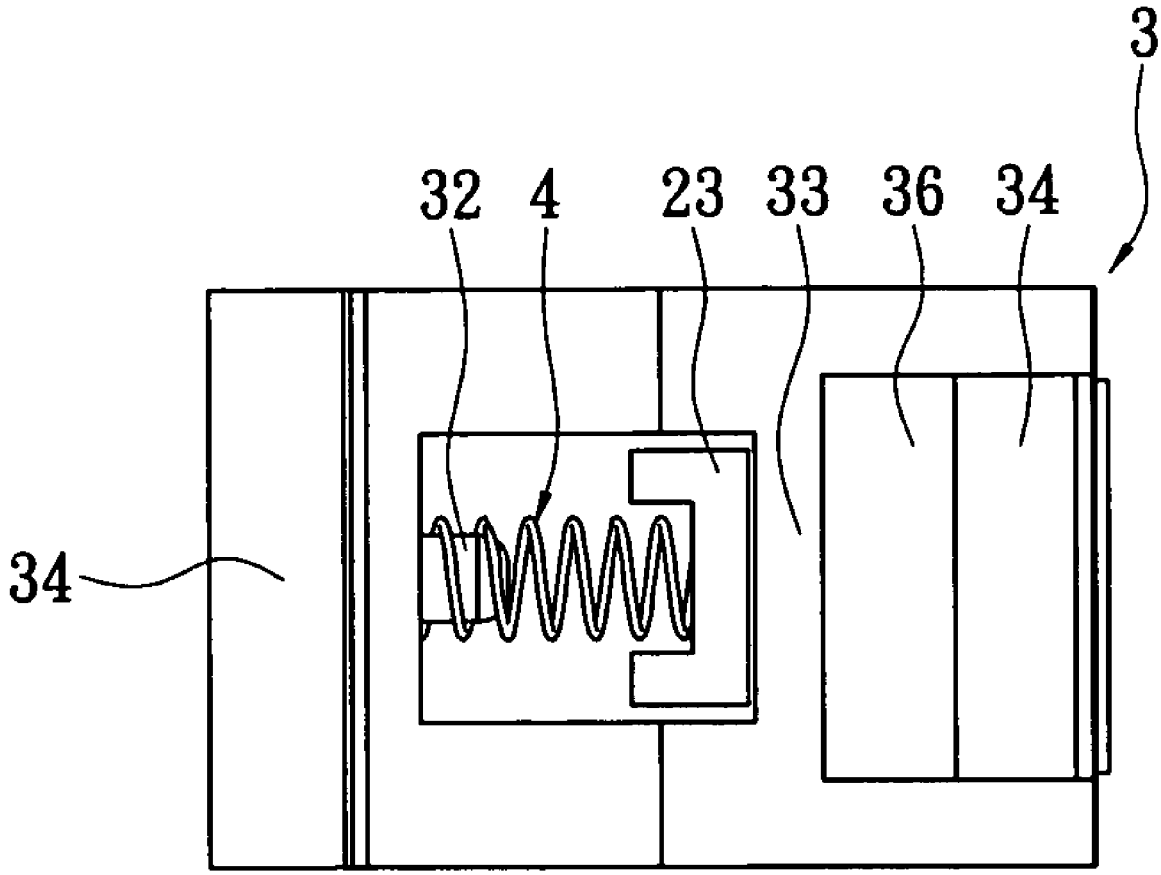
FIG. 2 is a top view of the socket safety apparatus of the present invention.
Figure 3:
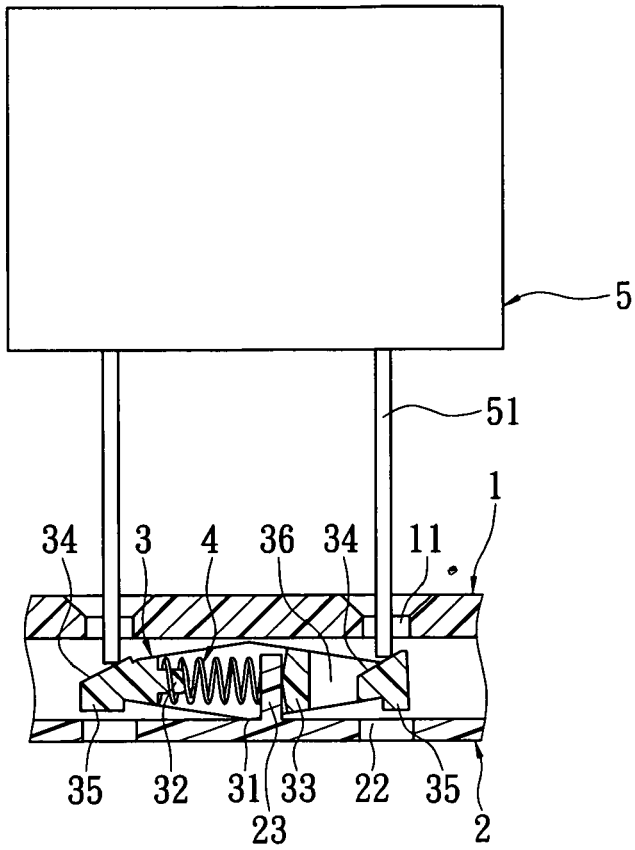
FIG. 3 is a cross-sectional diagram of the usage status of the socket safety apparatus of the present invention.

One side of the cover body 3 has a convex column. The convex column 32 corresponds to the fastening column 23 so that the flexible element 4 is located between the convex column 32 and the fastening column 23. The cover body 3 also has a positioning rod 33, and the positioning rod 33 is located at the center of the cover body 3. In this embodiment, the flexible element 4 is a compressed spring. One end of the flexible element 4 is sleeved onto the convex column 32 and another end of the flexible element 4 contacts the fastening column 23 so that the flexible element 4 is located between the cover body 3 and the lower cover 2. The flexible element 4 can push the cover body 3 to move to the left (as shown in FIGS. 2 and 3) to provide the recovery force for the cover body 3. Furthermore, by utilizing the positioning rod 33 to contact the fastening column 23, the cover body 3 covers the area between the two first plug holes 11 and the two second plug holes 22 in a normal status.

The two sides of the top surface of the cover body 3 respectively have a slant surface 34. The two slant surfaces correspond to the two first plug holes 11. The two slant surfaces tilt forwards the same direction so that the two plug pins 51 of the socket plug 5 can be plugged via the two first plug holes 11 at the same time. By contacting the two plug pins 51 to the two corresponding slant surfaces to push the cover body 3 to move forwards left and right, the cover body 3 does not cover the area between the two first plug holes 11 and the two second plug holes 22 again.

The cover body 3 has two braking portions 35. The two braking portions 35 protrude from the bottom surface of the cover body 3. In this embodiment, the two braking portions 35 are adjacent to the two sides of the cover body 3. The braking portion 35 is a platform or a convex point. The two braking portions 35 correspond to the two second plug holes 22. The cover body 3 further has a through hole 36. The through hole 36 passes through the top surface and the bottom surface of the cover body 3.

When the cover body 3 is in the balance status and two sides of the cover body 3 do not move upwards and downwards, the two braking portions 35 are located above the two second plug holes 22 so that the cover body 3 can move to left and right. When the cover body 3 is in the unbalance status and two sides of the cover body 3 move upwards and downwards, one braking portion 35 extends into the second plug hole 22 to brake the cover body 3 so that the cover body 3 cannot move left and right.

Figure 4:
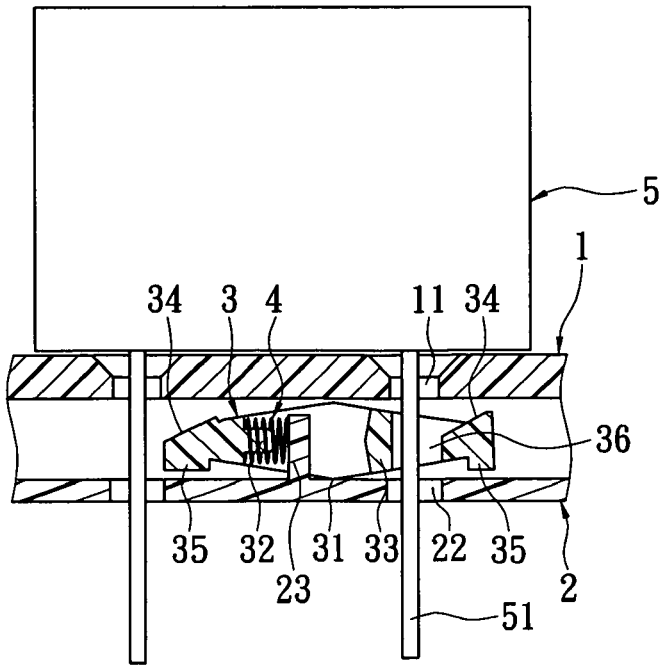
FIG. 4 is another cross-sectional diagram of the usage status of the socket safety apparatus of the present invention.

Reference is made to FIGS. 3 and 4. When the socket plug 5 is plugged into the socket, the two plug pins 51 of the socket plug 5 can be plugged into the socket safety apparatus of the present invention via the two first plug holes 11 of the upper cover 1. By contacting the two plug pins 51 to the two corresponding slant surfaces 34 (as shown in FIG. 3), the cover body 3 can be pushed to move left and right. In this embodiment, the cover body 3 moves to the right (as shown in FIG. 4) to make the two plug pins 51 correspond to the through hole 36 and the exterior of the cover body 3. Thereby, the cover body 3 does not cover the area between the two first plug holes 11 and the two second plug holes 22 again. The plug pins 51 of the socket plug 5 can pass through the two second plug holes 22 of the lower cover 2 to contact the conducting body below the lower cover 2.

Figure 5:
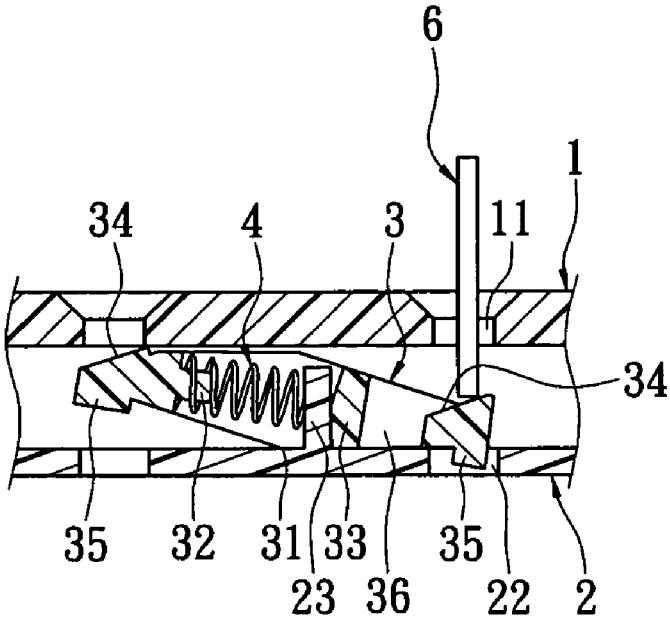
FIG. 5 is a cross-sectional diagram of the socket safety apparatus of the present invention being plugged with a foreign matter.
Figure 6:
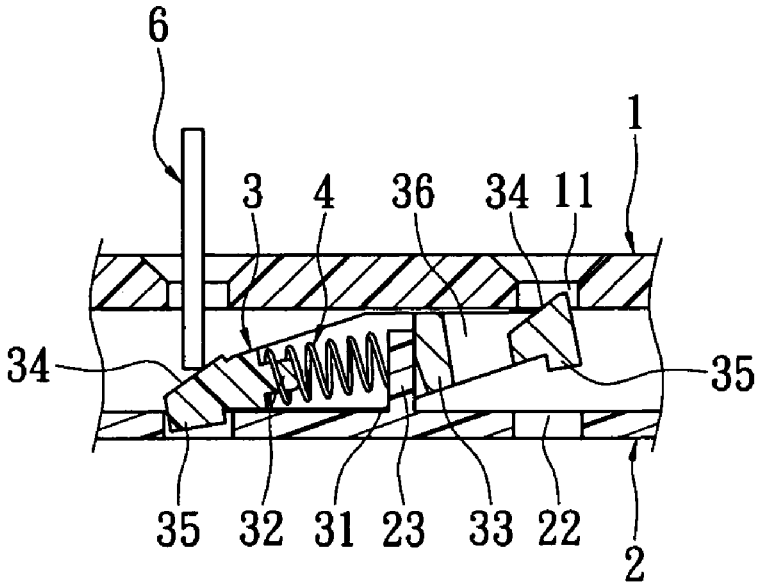
FIG. 6 is another cross-sectional diagram of the socket safety apparatus of the present invention being plugged with a foreign matter.

Reference is made to FIGS. 5 and 6. When a foreign matter 6 is plugged into the socket safety apparatus of the present invention via the first plug holes 11 of the upper cover 1, the foreign matter 6 merely can touch one slant surface 34. Therefore, the cover body 3 will be in the unbalance status. One side of the cover body 3 contacted by the foreign matter 6 moves downwards and the braking portion 35 extends into the second plug holes 22 to brake the cover body 3. Thereby, the cover body 3 cannot move left and right. Therefore, the cover body 3 can block the foreign matter 6 so that the foreign matter 6 cannot pass through the second plug holes 22 of the lower cover 2. It prevents the foreign matter 6 from contacting the conducting body below the lower cover 2.

Figure 7:
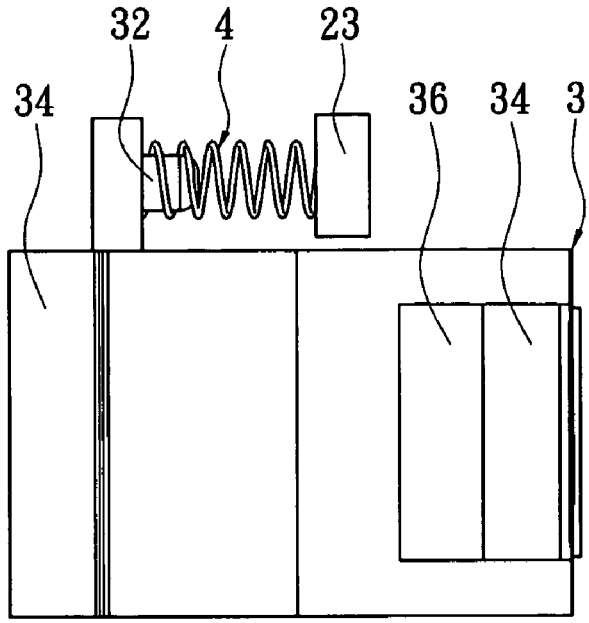
FIG. 7 is a top view of the socket safety apparatus of the second embodiment of the present invention.

Reference is made FIG. 7. In the second embodiment, the convex column 32 is located at one side of the exterior of the cover body 3. The fastening column 23 corresponds to the convex column 32. The flexible element 4 is located between the convex column 32 and the fastening column 23. One end of the flexible element 4 is sleeved onto the convex column 32, and another end of the flexible element 4 contacts the fastening column 23 so that the flexible element 4 pushes the cover body 3 to move to the left to provide the recovery force for the cover body 3.

Figure 8:
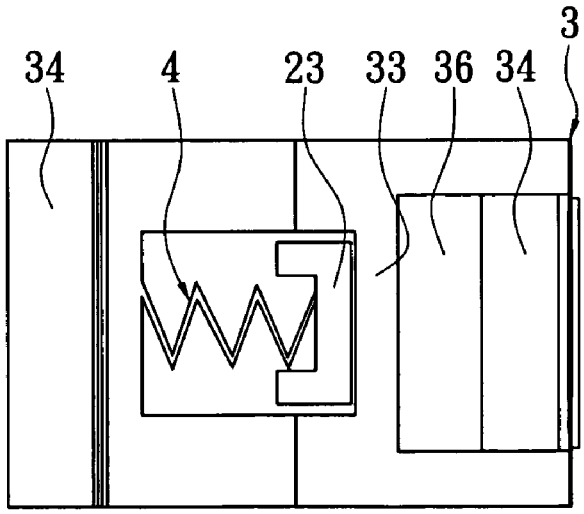
FIG. 8 is a top view of the socket safety apparatus of the third embodiment of the present invention.

Reference is made FIG. 8. In the third embodiment, the flexible element 4 is a bent flexible flake with multi-bending shape. In addition to assemble the flexible element 4 between the cover body 3 and the lower cover 2, the flexible element 4 also can be directly formed by the cover body 3 or the lower cover 2.

In the fourth embodiment (not shown), the two braking portions 35 can be located at the top surface of the cover body 3, or respectively located at the top surface and the bottom surface of the cover body 3. The quantity of the braking portions can be determined by the requirements. When the cover body 3 is in the unbalance status and one side of the cover body 3 contacted by the foreign matter 6 moves downwards, the braking portion 35 located at the top surface of the cover body 3 extends into the first plug hole 11 to brake the cover body 3. Therefore, the cover body 3 cannot move left and right.

The present invention utilizes the seesaw principle of the cover body 3. When the first plug hole 11 is plugged by a foreign matter 6, the cover body covers the area between the first plug hole 11 and the second plug hole 22, and the braking portion 35 corresponding to the second plug hole 22 (or first plug hole 11) can prevent the cover body 3 from moving to right or left so that the foreign matter cannot touch the conducting body of the socket. The present invention really can prevent the foreign matter from being plugged into the socket and prevent the user from getting an electric shock. The safety of the socket is improved. When a socket plug is normally plugged into the socket, the cover body 3 normally moves forward to one side so that the socket plug can touch the conducting body of the socket.

The description above only illustrates specific embodiments and examples of the present invention. The present invention should therefore cover various modifications and variations made to the herein-described structure and operations of the present invention, provided they fall within the scope of the present invention as defined in the following appended claims.

What is claimed is:

1. A socket safety apparatus, comprising:

an upper cover having two first plug holes;

a lower cover located below the upper cover, wherein the lower cover has two second plug holes that correspond to the first plug holes, and the lower cover is combined with the upper cover;

a cover body movably located between the upper cover and the lower cover, wherein the cover body is a rhombus shape and has a supporting portion, the supporting portion being a slant cone protruding from a bottom surface of the cover body, the supporting portion being formed at a center of said bottom surface of said cover body, and the supporting portion being in contact with said lower cover, the cover body is supported above the lower cover via the supporting portion, the cover body has two slant surfaces that correspond to the first plug holes and face to the same direction, and the cover body has two braking portions that protrude from said bottom surface of said cover body, said two breaking portions corresponding to the second plug holes and adjacent to the two sides of the cover body; and a flexible element pushing the cover body, wherein the flexible element pushes the cover body so that the cover body is covered between the two first plug holes and the second plug holes.

2. The socket safety apparatus as claimed in claim 1, wherein the lower cover has a receiving space, and the cover body is located in the receiving space of the lower cover.

3. The socket safety apparatus as claimed in claim 2, wherein the receiving space has a fastening column, the cover body has a convex column, the convex column corresponds to the fastening column, one end of the flexible element is sleeved onto the convex column, and another end of the flexible element contacts the fastening column.

4. The socket safety apparatus as claimed in claim 3, wherein the fastening column extends from the lower cover, and the fastening column is located between the two second plug holes.

5. The socket safety apparatus as claimed in claim 3, wherein the convex column is located at the interior or the exterior of the cover body.

6. The socket safety apparatus as claimed in claim 3, wherein the cover body has a positioning rod, and the positioning rod contacts the fastening column.

7. The socket safety apparatus as claimed in claim 1, wherein the flexible element is located between the cover body and the lower cover by an assembling way.

8. The socket safety apparatus as claimed in claim 1, wherein the flexible element is formed by the cover body or the lower cover.

9. The socket safety apparatus as claimed in claim 1, wherein the cover body has a through hole.

10. A socket safety apparatus, comprising:

an upper cover having two plug holes;

a lower cover located below the upper cover, wherein the lower cover has two plug holes that correspond to the plug holes of the upper cover, and the lower cover is combined with the upper cover;

a cover body movably located between the upper cover and the lower cover, wherein the cover body is a rhombus shape and has a supporting portion, the supporting portion being a slant cone protruding from a bottom surface of the cover body the supporting portion being formed at a center of said bottom surface of said cover body, and the supporting portion being in contact with said lower cover, the cover body is supported above the lower cover via the supporting portion, the cover body has two slant surfaces that correspond to the plug holes of the upper cover, and the cover body has two braking portions that protrude from said bottom surface of said cover body, said two breaking portions corresponds to the plug holes; and a flexible element pushing the cover body, wherein the flexible element pushes the cover body so that the cover body is covered between the first plug holes of the upper cover and the plug holes of the lower cover.

11. A socket safety apparatus, comprising:

an upper cover having two first plug holes;

a lower cover located below the upper cover, wherein the lower cover has two second plug holes that correspond to the first plug holes, and the lower cover is combined with the upper cover;

a cover body movably located between the upper cover and the lower cover, wherein the cover body has a supporting portion, the cover body is supported above the lower cover via the supporting portion, the cover body has two slant surfaces that correspond to the first plug holes and face to the same direction, and the cover body has two braking portions that correspond to the second plug holes, the two braking portions are located on the bottom surface of the cover body and adjacent to the two sides of the cover body; and a flexible element pushing the cover body, wherein the flexible element pushes the cover body so that the cover body is covered between the two first plug holes and the second plug holes, and wherein the flexible element is formed by the cover body or the lower cover.

* * * * *

UNITED STATES PATENT AND TRADEMARK OFFICE

CERTIFICATE OF CORRECTION

PATENT NO. : 7,637,756 B1
APPLICATION NO. : 12/318975
DATED : December 29, 2009
INVENTOR(S) : Jung-Hui Hsu It is certified that error appears in the above-identified patent and that said Letters Patent is hereby corrected as shown below:

In Title Page, item [30] under "Foreign Application Priority Data" insert:

--Sept. 8, 2008 (TW).....97134395 U--

Signed and Sealed this

Thirtieth Day of March, 2010

David J. Kappos

David J. Kappos
*Director of the United States Patent and Trademark Office*